United States Patent [19]

Uehara

[11] 4,078,335

[45] Mar. 14, 1978

[54] SLIDING CLOSURE PANEL ASSEMBLY

[75] Inventor: Take Uehara, Uozu, Japan

[73] Assignee: Yoshida Kogyo K.K., Tokyo, Japan

[21] Appl. No.: 786,387

[22] Filed: Apr. 11, 1977

[30] Foreign Application Priority Data

Apr. 12, 1976 Japan ..... 51-45681[U]

[51] Int. Cl.[2] ..... E05D 13/02

[52] U.S. Cl. ..... 49/425

[58] Field of Search ..... 49/425, 427, 420, 414, 49/421; 16/99, 100, 101, 97

[56] References Cited

U.S. PATENT DOCUMENTS

| | | | |
|---|---|---|---|
| 2,646,142 | 7/1953 | Watkins | 49/425 X |
| 2,867,859 | 1/1959 | Brink et al. | 49/420 |
| 3,284,953 | 11/1966 | Rifkin | 49/420 |
| 3,341,973 | 9/1967 | Miller | 49/420 |

*Primary Examiner*—Philip C. Kannan

*Attorney, Agent, or Firm*—Hill, Gross, Simpson, Van Santen, Steadman, Chiara & Simpson

[57] ABSTRACT

A sliding closure panel assembly which is movable along a horizontal track comprises a horizontal bottom member having a plurality of open areas extending laterally therethrough and spaced along the length thereof. A plurality of roller assemblies are mounted in a respective one of the open areas. Each of the roller assemblies includes a hollow frame rotatably carrying a roller and having a pair of opposed side walls and a pair of end walls interconnecting the side walls at their respective opposite ends. Each of the end walls has a notch of U-shaped contour in one edge. The periphery of the roller extends outwardly beyond one edge of each of the opposed side walls remote from the notches in the end walls for rolling engagement with a horizontal flat track surface. When the roller assembly is inverted, the roller is engageable with a horizontal vertical flange or rail with the pair of notches loosely receiving the flange or rail for positively guiding the sliding movement of the closure panel assembly therealong.

8 Claims, 6 Drawing Figures

SLIDING CLOSURE PANEL ASSEMBLY

BACKGROUND OF THE INVENTION

1. Field of the Invention

This invention relates to a sliding closure panel assembly having a plurality of roller assemblies attached to the horizontal bottom rail member thereof to enable the sliding movement of the closure panel assembly along a horizontal track.

2. Prior Art

Most of the conventional roller assemblies of this general type are designed either for use with a horizontal track of an upwardly opening channel-shaped cross-section having a horizontal base with which the associated rollers are adapted to be in rolling engagement, or for use with a horizontal track having a longitudinal vertical flange on its upper surface on which the associated rollers are adapted to rollably ride. One form of roller assembly which could be adapted for use with both tracks is also known in which a roller frame rotatably carries a roller in such a manner that the periphery of the roller wheel extends outwardly from the frame for rolling engagement with either a horizontal base or a vertical flange. This roller assembly is not entirely satisfactory, however, in that when used with the track having the longitudinal vertical flange, the roller wheel is subject to derailment. Another disadvantage of the conventional roller assemblies is that they have relatively many component parts and hence are somewhat complicated in construction.

SUMMARY OF THE INVENTION

According to the invention, a sliding closure panel assembly which is movable along a horizontal track comprises a horizontal bottom member having a plurality of open areas extending laterally therethrough and spaced along the length thereof. A plurality of roller assemblies are mounted in the plurality of open areas. Each of the roller assemblies comprises a hollow frame having a pair of opposed side walls and a pair of end walls interconnecting the side walls at their respective opposite ends, each of the end walls in one edge a notch of U-shaped contour which is defined by a pair of lateral edges and an end edge lying therebetween. The frame is so sized and shaped as to be fitted in a respective one of the open areas. A roller is rotatably supported by and disposed between the opposed side walls for rolling engagement with the horizontal track for guiding the movement of the closure panel assembly therealong. The periphery of the roller extends to a radial height between the end edge of each of the notches and one edge of each of the opposed side walls contiguous to said one edge of the end wall. The periphery of the roller wheel also extends beyond the other edges of the opposed side walls. A pair of retainers are formed integrally with and extend from the end walls in opposite directions, each of the retainers being disposed intermediate the notch and the other edge of the end wall, and interposed between and frictionally engaging opposed flanges of the bottom member to retain the roller assembly.

It is therefore an object of the present invention to provide a closure panel assembly having roller assemblies which enable the closure panel assembly to be used with either an upwardly opening channeled track or a track having a vertical longitudinal flange or rail in a manner to positively guide the sliding movement of the closure panel assembly.

Another object is to provide a roller assembly for use with closure panel assemblies which has a minimum number of component parts which is sturdy in construction and inexpensive to manufacture, and which is easily attached to the closure panel assemblies.

Many other advantages and features of the present invention will become manifest to those versed in the art upon making reference to the detailed description and the accompanying sheets of drawings in which a preferred structural embodiment incorporating the principles of the present invention is shown by way of example.

DESCRIPTION OF THE PREFERRED EMBODIMENT

Figure 1:
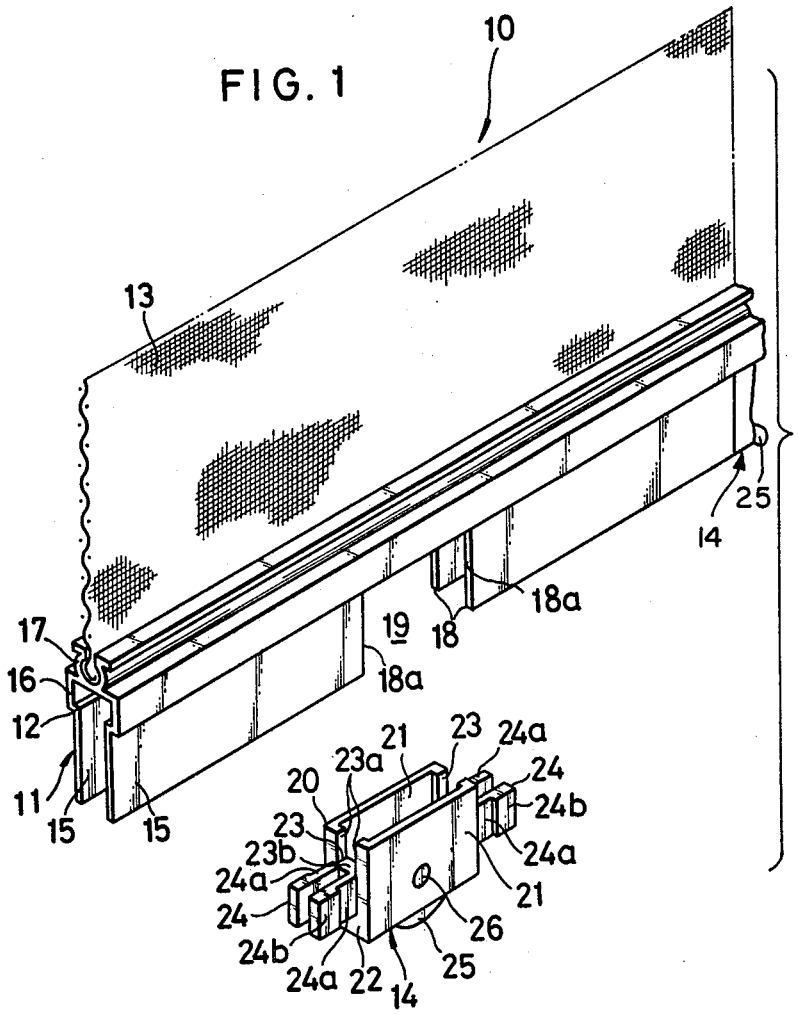
FIG. 1 is a perspective view of a portion of a sliding closure panel assembly provided in accordance with the present invention, showing a roller assembly just before it is mounted on the closure panel assembly.
Figure 5:
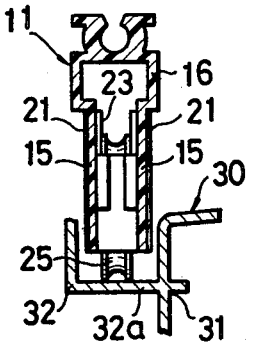
FIG. 5 is a vertical transverse cross-sectional view of the roller assembly shown in engagement with a channeled track.
Figure 6:
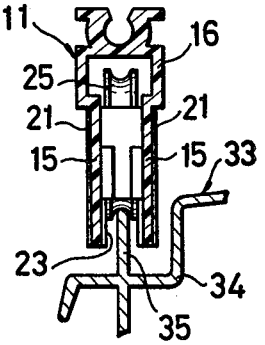
FIG. 6 is a view similar to FIG. 4 but showing the roller assembly in engagement with a track having a vertical flange.

FIG. 1 shows a portion of a sliding closure panel assembly or screen sash 10 adapted to be mounted within an outer frame 30, 33 (FIGS. 5 and 6), installed in an opening in a building wall, for horizontal movement between an opened and a closed position. The sash 10 comprises a rectangular frame 11 having a horizontal bottom rail member 12, a screen panel 13 mounted within the frame 11, and a plurality of roller assemblies 14 mounted on the bottom rail member 12 and spaced along the length thereof, one of the roller assemblies 14 being shown detached from the bottom rail member 12.

The bottom rail member 12 includes a body of a generally downwardly opening channel-shaped cross-section which is made of a synthetic resin and has a pair of parallel spaced arms or flanges 15,15 and a base 16 of an inverted U-shaped cross-section interconnecting the arms 15,15 at their upper edges. The bottom rail member 12 has an upwardly opening channel portion 17 formed integrally with and extending along the base 16. The channel portion 17 receives and retains a lower marginal portion of the screen panel 13 in a known manner. A plurality of pairs of downwardly opening opposed openings or notches 18,18 of an inverted U-shaped contour are formed through the arms or flanges 15,15 respectively, in longitudinally spaced relation to provide a plurality of open areas 19 extending transversely through the bottom rail member 12 and spaced along the length thereof and bounded at the top by the lower edges of the base 16.

Each of the roller assemblies 14 has a hollow frame 20 of a rectangular horizontal cross-section defined by a pair of parallel spaced apart side walls 21,21 of a rectangular shape and a pair of end walls 22,22 interconnecting the side walls 21,21 at their respective opposite ends.

Each of the end walls 22,22 has a notch 23 of U-shaped contour in one edge which is defined by a pair of parallel lateral edges **23*a*,23*a* and an end edge 23*b* lying therebetween. The width of the roller frame 20 across the side walls 21,21 is slightly greater than that of the bottom rail member 12 across the opposed arms or flanges 15,15. The length of each of the side walls 21,21 is substantially equal to the length of the opening 18**.

Formed integrally with and extending from the end walls 22,22 in opposite directions are a pair of retainers 24,24 each comprising a pair of laterally spaced apart rectangular sections **24*a*,24*a* each having its distal end portion thickened to provide an engaging portion 24*b*. One edge of each of the rectangular sections 24*a*,24*a* lies vertically flush with the end edge 23*b* of the notch 23 while the other edge is disposed intermediate the end edge 23*b* and the edge of the end wall 22 remote from the notch 23**.

Figure 2:
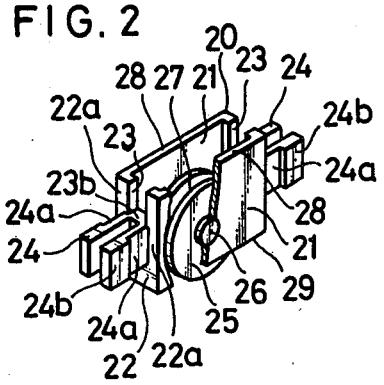
FIG. 2 is a perspective view of the roller assembly with a part broken away.
Figure 3:
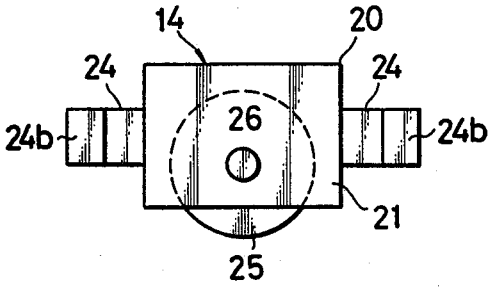
FIG. 3 is a side elevational view of the roller assembly.
Figure 4:
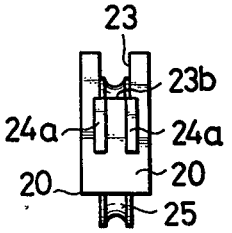
FIG. 4 is an end view of the roller assembly.

Each of the roller assemblies 14 has a roller 25 rotatably mounted on a pin member 26 and disposed between the side walls 21,21, the pin member 26 here comprising a rivet journalled in the side walls 21,21 at opposite ends, and the roller 25 having a peripheral groove 27. As best shown in FIGS. 2, 3 and 4, the upper periphery of the roller 25 is disposed at a height between that of the end edge **23*b* and the upper edges 28,28 of the side walls 21,21. The periphery of the roller 25 also extends outwardly beyond the lower edges 29,29 of the side walls 21,21. The bottom of the peripheral groove 27 is also disposed at a height above the end edge 23*b***. Upper and lower are used as terms of reference only.

When the screen sash 10 is to be mounted within the outer frame 30, which includes a horizontal sill 31 having an upwardly opening channel-shaped track 32 (FIG. 5), each of the roller assemblies 14 is mounted in a respective one of the longitudinally spaced open areas 19 from below in such a manner that each of the side walls 21,21 is snugly fitted in the respective opening 18 with the marginal portions **22*a*,22*a* of the end walls 22,22 in engagement with the opposite vertical edges 18*a*,18*a* of the opening 18, and with the edge 28 of each of the side walls 21,21 in engagement with the lower horizontal edge of the base 16 within the opening 18. For attachment of each of the roller assemblies 14 to the bottom rail member 12, each pair of opposed rectangular sections 24*a*,24*a* is first urged toward each other with a finger pressure and is then forced in between the opposed arms or flanges 15,15 with their thickened engaging portions 24*b*,24*b* in frictional engagement therewith. The screen sash 10 is mounted within the outer frame 30 with the respective rollers 25 in rolling engagement with a horizontal base 32*a* of the channel-shaped track 32. Each of the roller frames 20 is slightly narrower than the track 32 so that the roller frames 20 serve to minimize the movement of the screen sash in the direction of the axes of the pin members 26, thereby facilitating the sliding movement of the sash 10 and silencing rattle noises caused by the sash 10** during the sliding movement thereof.

When the screen sash 10 is to be installed within an outer frame 33 including a horizontal sill 34 having a vertical longitudinal flange or rail 35 on an upper surface thereof (FIG. 6), each of the roller assemblies 14 is first inverted and then mounted in the respective open area 19 in the same manner as described above with the edge 29 of each of the side walls in engagement with the lower horizontal edge of the base 16 within the opening 18. The screen sash 10 is mounted within the outer frame 33 with the rollers 25 riding on the vertical flange 35. The pair of notches 23,23 in the opposite end walls 22,22 loosely receive the vertical flange 35 to restrain the lateral movement of the roller wheel 25 against derailment, thereby positively guiding the sliding movement of the screen sash.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A sliding closure panel assembly movable along a horizontal track, said panel assembly comprising:

(a) a horizontal bottom member of generally downwardly opening channel-shaped cross-section defined by a base and a pair of opposed flanges interconnected by said base along one of their edges, said flanges having a plurality of pairs of downwardly-open aligned openings providing open areas spaced along the length of said bottom member; and (b) a plurality of roller assemblies mounted in said plurality of open areas, respectively, each of said roller assemblies comprising:

(1) a hollow frame having a pair of opposed side walls and a pair of end walls interconnecting said side walls at their respective opposite ends, each of said end walls having in one edge a notch defined by a pair of lateral edges and an end edge lying therebetween, said frame having a size and shape receptive in a respective one of said open areas;

(2) a roller rotatably supported by and disposed between said side walls for rolling engagement with the horizontal track, the periphery of said roller having a vertical radial height in one direction extending to a point between that of said end edge of each of said notches and one edge of each of said opposed side walls contiguous to said one edge of said end wall, and in the opposite direction extending outwardly beyond the other edges of said opposed side walls; and (3) a pair of retainers joined to and extending from said end walls in opposite directions, each of said retainers being disposed intermediate said notch and the other edge of said end wall, and extending between and frictionally engaging said flanges and retaining said roller assembly in said bottom member.

2. A sliding closure panel assembly according to claim 1, each of said aligned openings having a generally inverted U-shaped contour, and said roller frame having a rectangular horizontal cross-section, said aligned side walls being parallel and rectangular.

3. A sliding closure panel assembly according to claim 1, for use with a horizontal track having a longitudinal upwardly directed vertical flange extending therealong, the width of said notch between said lateral edges being greater than that of the vertical flange, and being less than the space between said flanges, and each of said roller assemblies being mounted in said respective open area with said one edge of each of said opposed side walls facing the horizontal track, for enabling said roller to rollingly engage the vertical flange with said pair of notches loosely receiving the vertical flange therein.

4. A sliding closure panel assembly according to claim 1, said retainers being formed integrally with said end walls.

5. A sliding closure panel assembly according to claim 1, each of said retainers comprising a pair of opposed sections spaced in the transverse direction of said bottom member.

6. A sliding closure panel assembly according to claim 1, said roller frame comprising synthetic resin.

7. A sliding closure panel assembly according to claim 1, for use with a horizontal track having a flat upwardly directed surface, each of said roller assemblies being mounted in said respective open area with said other edges of said opposed side walls facing the horizontal track, for enabling said roller to rollingly engage the flat surface.

8. A sliding closure panel assembly according to claim 7, the width of said frame across said opposed side walls being slightly greater than the width of said bottom member across said flanges so that said opposed side walls project slightly laterally from said flanges, respectively.

* * * * *